US005971081A

United States Patent [19]

Stewart

[11] Patent Number: 5,971,081

[45] Date of Patent: Oct. 26, 1999

[54] DEVICE TO EXTINGUISH BURNING CANDLES

[76] Inventor: Molook Emi Stewart, P.O. Box 764, Ross, Calif. 94957

[21] Appl. No.: 09/114,733

[22] Filed: Jul. 13, 1998

[51] Int. Cl.[6] ..... A62C 3/00; F23Q 25/00

[52] U.S. Cl. ..... 169/54; 431/144

[58] Field of Search ..... 169/54, 91, 43, 169/46, 49; 431/144

[56] References Cited

U.S. PATENT DOCUMENTS

| | | | |
|---|---|---|---|
| Re. 4,841 | 4/1872 | Stow et al. . | |
| 849,789 | 4/1907 | Hurd | 294/99.2 |
| 940,832 | 11/1909 | Swoger . | |
| 4,497,374 | 2/1985 | Millar | 169/46 |
| 5,282,737 | 2/1994 | Ray | 169/46 X |

*Primary Examiner*—Lesley D. Morris
*Attorney, Agent, or Firm*—Paul R. Martin

[57] ABSTRACT

A device for extinguishing flames without leaving residual smoke is described. The device is a tweezer like device with wax pads attached to the tips thereof, wherein the wax pads oppose one another. When opposing wax pads are brought together with a burning candle wick there between, the flame of the wick is extinguished without residual smoke being generated.

8 Claims, 1 Drawing Sheet

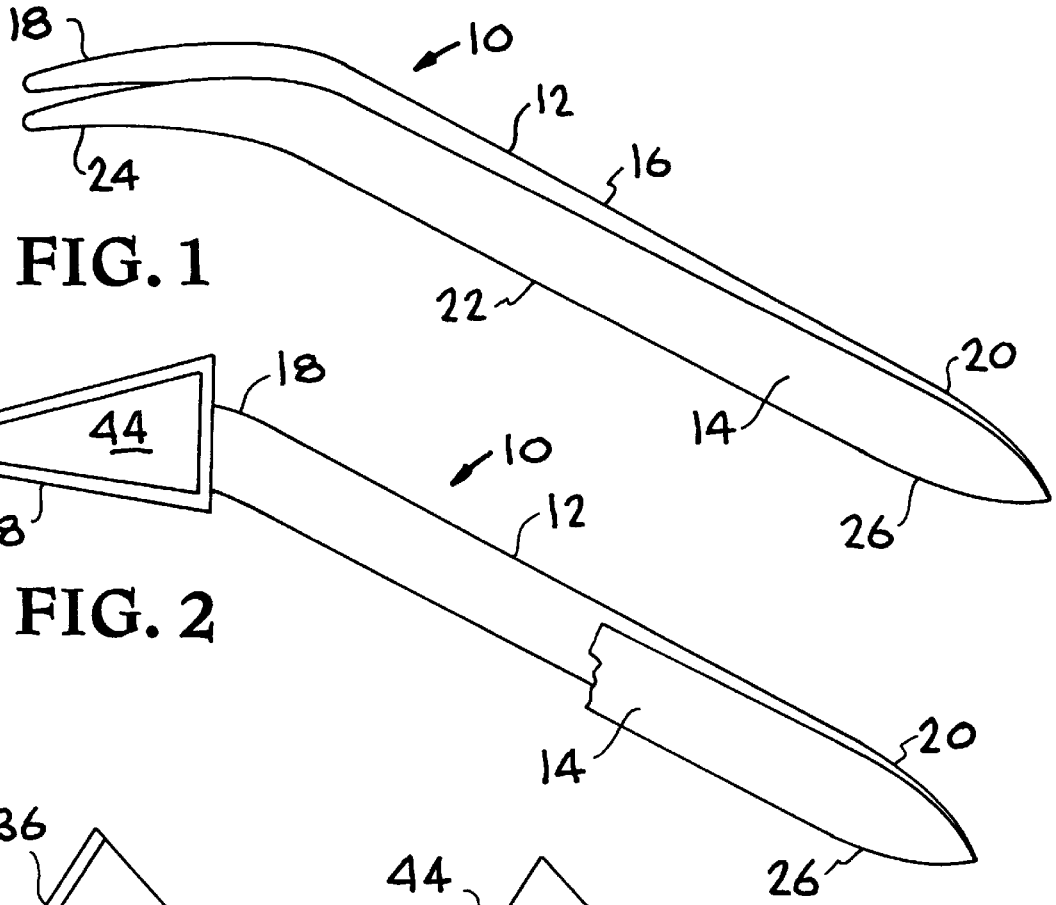
FIG. 1
FIG. 2
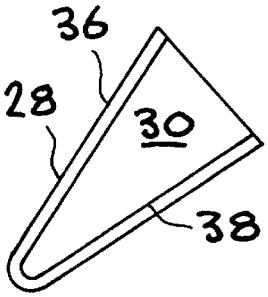
FIG. 3
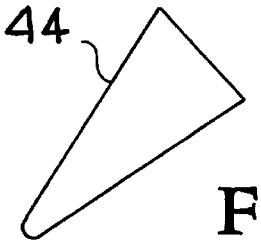
FIG. 4
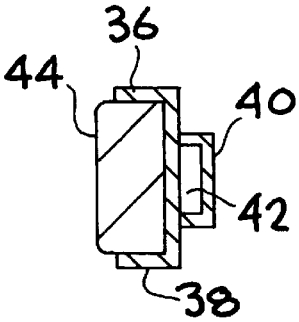
FIG. 5
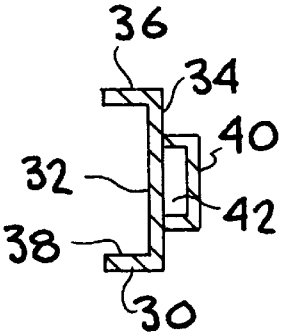
FIG. 6
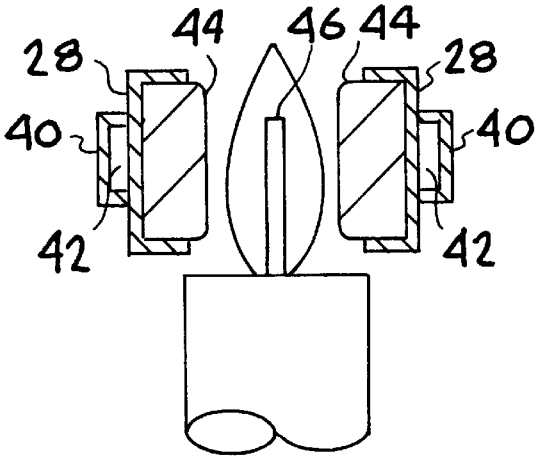
FIG. 7

DEVICE TO EXTINGUISH BURNING CANDLES

FIELD OF THE INVENTION

The present invention relates to a device which can be used to extinguish small fires. In particular, it relates to a device which is suitable for use in extinguishing small fires such as those associated with the wick of a burning candle, without leaving residual smoke.

BACKGROUND OF THE INVENTION

It is known that many asthmatics and others who have lung diseases such as emphysema, have extreme difficulty breathing in a smoky environment. Even very dilute concentrations of smoke can cause asthmatics to have attacks which can be life threatening. For that reason, asthmatics tend not to burn candles for decorative purposes around the home and elsewhere, because when a burning candle is extinguished using conventional techniques, the wick of the candle will give off substantial quantities of smoke after the actual fire is extinguished. Often times, this residual smoke will trigger an asthma attack.

SUMMARY OF THE INVENTION

The present invention is specifically designed to enable small fires to be extinguished such as those associated with the wicks of candles, without leaving a residue of smoke after the fire is extinguished. Thus, there is provided a smokeless fire extinguishing device. The device has the shape of conventional tweezers, having opposing attachments positioned on the tips thereof which have inwardly facing wax inserts. When it is desired to extinguish the flame of a candle, the tips of the device are positioned on opposite sides of the burning wick of the candle, and then forced together. The wax inserts on the attachments on the tips come into contact with the wick of the candle, extinguishing the flame without there being a smoke residue.

BRIEF DESCRIPTION OF THE DRAWINGS

FIG. 1 is a perspective view of a conventional pair of tweezers which form a part of the device of the invention.

FIG. 2 is a perspective view with parts broken away of the device of the invention, showing a pad mounted on the tip of the device of the invention with an inwardly facing wax insert positioned therein.

FIG. 3 is a perspective view of the attachment for the tip of the device of the invention.

FIG. 4 is a perspective view of the Wax insert for the attachment shown in FIG. 3.

FIG. 5 is a cross sectional view of the attachment of FIG. 3, showing the wax insert of FIG. 4 inserted in place.

FIG. 6. is a cross sectional view through line 6—6 of FIG. 3 showing the slot configuration used for mounting the attachment onto the tip of the tweezers.

FIG. 7 is a cross sectional view of the extreme forward end of the device of the invention showing a burning wick of a candle positioned there between.

DETAILED DESCRIPTION OF THE INVENTION

The present invention comprises, as best seen in FIGS. 1 and 2, a tweezers like device 10 consisting of a pair of identical opposing leaves or blades 12 and 14. Blade 12 has a body portion 16, a forward end 18 and a rearward end 20, and blade 14 has a body portion 22, a forward end 24 and a rearward end 26. Each blade 12 and 14 tapers to a small point at their respective forward ends 18 and 24. The forward ends 18 and 24 of each blade 12 and 14 are offset at an angle relative to the body portions 16 and 22 respectively. The blades 12 and 14 are permanently attached to each other at their rearward ends 20 and 26, projecting outward from each other at an angle. The angle of diversion is not critical, but generally ranges from about 15 to 20 degrees. In at rest position, the forward ends 18 and 24 of the respective blades are spaced apart from each other. The blades 12 and 14 are made of a flexible material, preferably steel. When desired, the opposing blades 12 and 14 can be grasped with the fingers and urged together.

A removable attachment 28 (FIGS. 2 and 3) is positioned on the forward ends 18 and 24 of each of the blades 12 and 14. The attachment 28 comprises a flat base 30 having top 32 and bottom 34 surfaces with upwardly projecting walls 36 and 38 extending from each side of the base 30. The bottom surface 34 of the base 30 has an additional U shaped channel piece 40 fastened thereto at opposing sides thereof, defining a slot 42 which extends substantially the length of the base. The dimensional configuration of the slot 42 is such that it is adapted to receive the forward ends 18 and 24 of the blades 12 and 14 when the attachment 28 is slipped over the respective ends thereof. The base 30 of the attachment 28 is preferably triangular in shape, although the actual shape is not critical. What is important is that the shape of the slot 42 conform to the shape of the forward ends 18 and 24 of the blades 12 and 14, so that when the attachment 28 is slipped over the forward ends of the blades 12 and 14, the fit is snug.

A removable wax insert 44 (FIGS. 4, 5 and 6) is positioned in that space defined by the base 30 and upwardly projecting walls 36 and 38 of the attachment 28. The wax insert 44 projects above the walls 36 and 38, as best seen in FIGS. 5 and 7. The wax can be of any composition, but is preferably that type of wax used in conventional candles. The was pad should be of sufficient dimension that it encompasses the length of a candle wick when brought into contact with it.

As seen in FIG. 7, the attachments 28 are positioned on the forward ends 18 and 24 of the blades 12 and 14 so that the wax pads 44 are facing inwardly.

In operation, the opposing forward ends 18 and 24 of the device 10, with the inwardly facing removable attachments 28 in place, are positioned such that a burning candle wick 46 is there between (FIG. 7). The blades 12 and 14 are then squeezed together. The wax pads 44 engage the burning wick 46 through its entire length and snuff out the fire. There is no residual smoke.

The device according to the present invention has been shown and described with reference to preferred embodiments. However, it should be obvious to one of ordinary skill in the art that modifications or changes made be made to the device while keeping within the scope of the invention as defined in the following claims.

I claim:

1. A device for extinguishing fires comprising:

a tweezer like unit consisting of opposing blades, having forward and rearward ends, said blades being attached to each other at the rearward ends thereof and spaced apart from each other at the forward ends thereof, and a removable attachment having a wax pad mounted thereon positioned on the forward ends of each of said blades, said attachments being positioned on said blades in a manner such that said wax pads oppose each other and are sufficiently spaced apart to define a space sufficient to interpose a burning wick there between, whereby when said blades are squeezed together, said wax pads come into contact with said burning wick, thereby extinguishing the flame associated with said wick without residual smoke.

2. The device of claim 1 wherein said blades are made of a flexible metal.

3. The device of claim 1 wherein said blades are made of steel.

4. The device of claim 1 in which said removable attachment is triangular in shape.

5. The device of claim 1 in which said removable attachment is attached to said blades by means of a slot in the back side thereof adapted to receive the forward ends thereof.

6. The device of claim 1 wherein said wax pad is removable.

7. The device of claim 1 wherein said wax pad has the same composition of household candles.

8. The device of claim 1 wherein said removable attachment comprises a triangular shaped flat base having top and bottom surfaces, with walls projecting from the edges thereof, and a U shaped channel fixed to the bottom surface thereof defining a slot between the inner wall of the channel and the bottom surface of the base.

* * * * *